US006356034B1

(12) United States Patent
Chen

(10) Patent No.: US 6,356,034 B1
(45) Date of Patent: Mar. 12, 2002

(54) LOW VOLTAGE DISCHARGE LAMP POWER SUPPLY

(75) Inventor: Xiao Chen Chen, Zhong Shan (CN)

(73) Assignee: Regal King Manufacturing Limited, Kowloon (HK)

( * ) Notice: Subject to any disclaimer, the term of this patent is extended or adjusted under 35 U.S.C. 154(b) by 0 days.

(21) Appl. No.: 09/532,693

(22) Filed: Mar. 22, 2000

(51) Int. Cl.[7] ..... H05B 41/36
(52) U.S. Cl. ..... 315/209 R; 315/219; 315/224
(58) Field of Search ..... 315/224, 291, 315/209 R, 276, 219, 225, 307, 244

(56) References Cited

U.S. PATENT DOCUMENTS

| | | | | |
|---|---|---|---|---|
| 5,023,516 A | | 6/1991 | Ito et al. | 315/101 |
| 5,251,119 A | | 10/1993 | Maehara | 363/37 |
| 5,274,540 A | | 12/1993 | Maehara | 363/37 |
| 5,559,405 A | * | 9/1996 | Otohamiprodjo | 315/224 |
| 5,677,601 A | * | 10/1997 | Zuchtriegel | 315/224 |
| 5,757,143 A | | 5/1998 | Martucci et al. | 315/247 |
| 5,777,861 A | | 7/1998 | Shimizu | 363/37 |
| 5,872,430 A | | 2/1999 | Konopka | 315/219 |
| 5,880,564 A | | 3/1999 | Franck | 315/247 |
| 6,104,142 A | * | 8/2000 | Zuchtriegel | 315/209 R |

OTHER PUBLICATIONS

Power Electronics p. 17 (undated).

* cited by examiner

*Primary Examiner*—Don Wong
*Assistant Examiner*—Wilson Lee
(74) *Attorney, Agent, or Firm*—Baker, Donelson, Bearman & Caldwell

(57) ABSTRACT

A power supply for a gas discharge lamp has an oscillating circuit with two switches connected at a node in series and controlled by an oscillation ignition circuit having a diode that operates above a selected voltage threshold level. An energy storage circuit is connected to the node of the oscillating circuit switches and to the oscillation ignition circuit. It supplies energy to the oscillation ignition circuit and the oscillating circuit while voltage is momentarily below the selected voltage threshold level of the diode.

9 Claims, 2 Drawing Sheets

LOW VOLTAGE DISCHARGE LAMP POWER SUPPLY

TECHNICAL FIELD

This invention relates generally to power supplies, and, more particularly, to power supplies that use push-pull, semi-bridging self-oscillating circuits in providing low voltages at high frequencies to loads such as gas discharge lamps.

BACKGROUND OF THE INVENTION

Power supplies for lamps commonly provide some 110 volts from a line source or ballast. Flourescent lamps, for example, employ such at high frequency to avoid visible flickering. However, discharge lamps, such as halogen lamps, require only some 12 volts of potential. Being a gas discharge device, they cannot operate on DC current. Thus they have a somewhat unique power supply requirement of high frequency yet low voltage with the resulting benefit of low power requirement.

Halogen lamps are usually powered by push-pull, semi-bridged self oscillating circuits. An example of such circuit comprises a pair of switching devices arranged in series between the output terminals of a rectifier. The rectifier receives power from an AC power source via a filter circuit and converts the AC voltage to pulsating DC voltage. The switching devices are connected in parallel with two series capacitors. Two diodes for supplying currents in opposite directions to the load are connected in parallel with the switching devices and with the output terminals of the rectifier. The node of the series diodes is connected with the node of the series switching devices. The capacitance of one capacitor ("Larger Capacitor") is greater than that of the other capacitor ("Smaller Capacitor"). A diode is connected in parallel with the Smaller Capacitor. A series circuit of an inductor and a discharge lamp is connected between the node of the switching devices and the node of the series capacitors. A third capacitor ("Load Capacitor") is connected between the end terminals of the discharge lamp. The discharge lamp and Load Capacitor therefore become part of two series loops. In one loop, the discharge lamp/Load capacitor is in series with the Smaller Capacitor, a switching device ("First Switching Device") and the inductor. In the other loop, the discharge lamp/Load Capacitor is in series with the inductor, the other switching device ("Second Switching Device") and the Larger Capacitor.

The switching devices are controlled by a switching control circuit that is also powered via the rectifier. The switching control circuit causes the switching devices to switch On and Off in an alternating manner at a very high frequency. In the ON period of one switching device, current is supplied from the rectifier to the inductor, the discharge lamp, and the Larger Capacitor via the switching device. During this ON period, the Larger Capacitor is charged. In the time interval after the switching device is turned off, and before the other switching device is turned on, the inductor supplies current to the discharge lamp and the Larger Capacitor. When the other switching device is turned on, the Larger Capacitor discharges via the discharge lamp, the inductor and the other switching device. In the time interval after the other switching device is turned off, and before the one switching device is turned back on, the inductor supplies current to the discharge lamp and the Smaller Capacitor via one of the in-series diodes.

A problem with such a push-pull oscillating circuit is that during the period when the pulsating output voltage from the rectifier is at or near zero, no input current is momentarily supplied to the switching control circuit because the voltage supply is below the breakdown voltage of one or more components of the switching control circuit. This results in a discontinuous current waveform being supplied to the gas discharge lamp thereby limiting the power factor of the power supply. Thus if a gas discharge lamp power supply could be devised having the high frequency discharge of a push-pull, semi-bridging oscillating circuit, yet with a power factor greater than 99%, a distinct advantage could be achieved. Accordingly, it is the provision of such that the present invention is primarily directed.

SUMMARY OF THE INVENTION

A power supply for a gas discharge lamp comprises an oscillating circuit having two switches connected in series at a node and controlled by an oscillation ignition circuit that has a diode that operates above a selected voltage threshold level. An energy storage circuit is connected to the node of the oscillating circuit switches and to the oscillation ignition circuit for supplying energy to the oscillation ignition circuit and the oscillating circuit while output voltage is below the selected voltage threshold level of the diode. It has been found that this circuit serves to provide a power supply power factor in excess of 99%.

DETAILED DESCRIPTION OF THE PREFERRED EMBODIMENT

Figure 1:
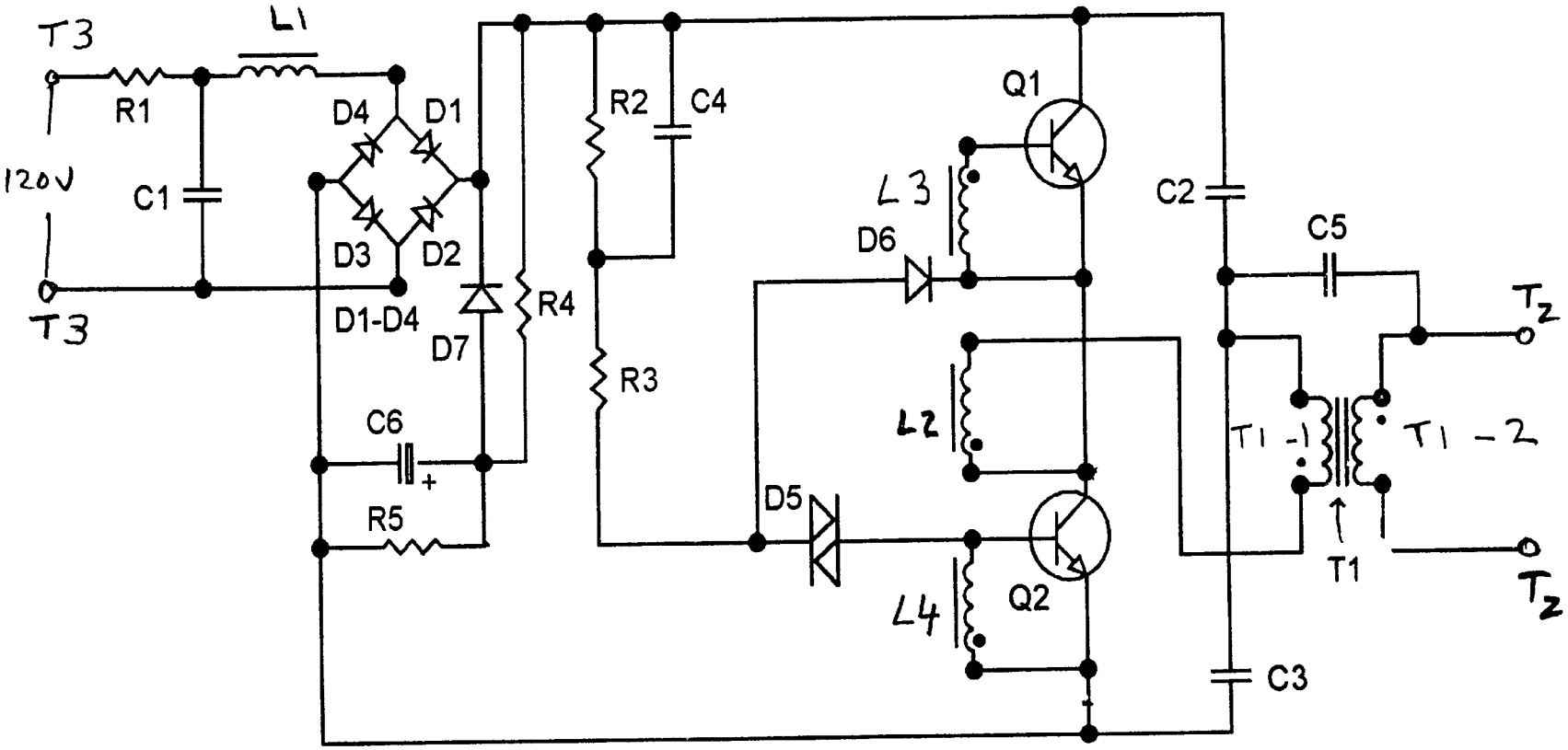
FIG. 1 is a circuit diagram of the preferred form of the invention.

With reference to FIG. 1, there is shown a circuit diagram of a preferred form of the power supply. The power supply has a filter circuit to remove high frequency noise and to suppress surge current, for example, surge current flow through during sudden on and off that causes high frequency noise and interferences through a connector cord. The filter circuit comprises a resistor R1 in series with a capacitor C1 which are connected across terminals T3, and an inductor L1 connected to the node of the resistor R1 and capacitor C1. The terminals are adapted to be connected to conventional 120 VAC line. The filter circuit output is connected to a full wave rectifier in the form of four bridged diodes D1–D4. The rectifier in turn is connected to energy storage circuitry comprised of capacitor C6, resistors R4 and R5, and diode D7. Capacitor C6 is connected in series with diode D7 in parallel with resistor R4 across the output terminals of the diode bridge. Resistor R5 is connected in parallel with capacitor C6.

The series of transistors Q1 and Q2 and the series of capacitors C2 and C3 are each connected across the output terminals of the diode bridge and parallel to one another. The node of capacitors C2 and C3 is connected to the node of transistors Q1 and Q2 via power transformer T1-1 and inductor L2. Inductors L3 and L4 are coupled across the bases and emitters of Q1 and Q2, respectively. The ends of the secondary winding of the transformer T1-2 are connected to opposing output terminals T2 which supply power to a halogen lamp. A capacitor C5 connects one of the output terminals T2 to the node of capacitors C2 and C3.

The power supply circuit also comprises an oscillation ignited circuit that includes a double diode D5 connected in series with the base of transistor Q2 and the resistor R3. Resistors R2 and R3 are connected in series between the positive terminal of the diode bridge and the node of the diode D6 and double diode D5. A capacitor C4 is connected in parallel to resistor R2.

Figure 2:
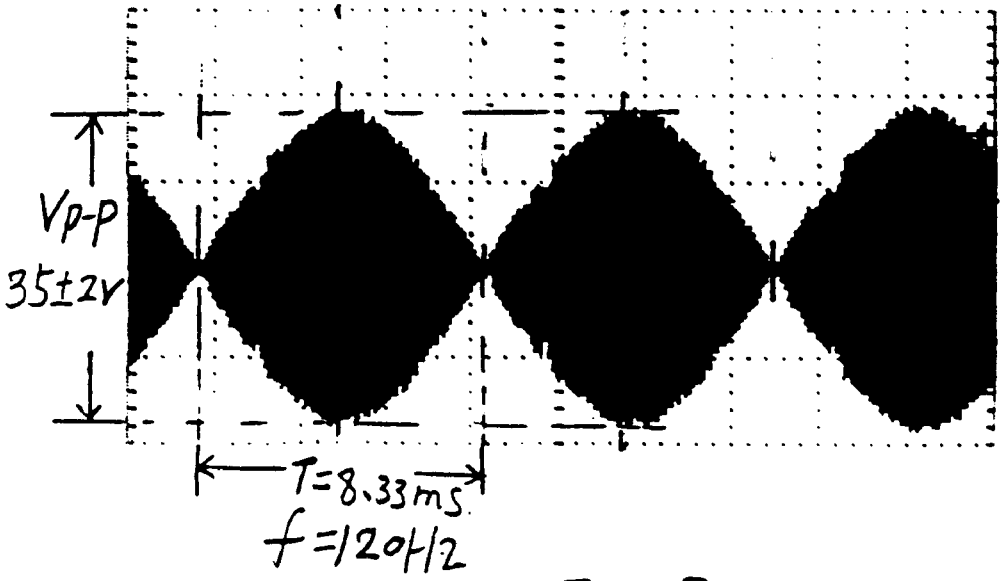
FIG. 2 is a graph showing the waveform of the output of the power supply.
Figure 3:
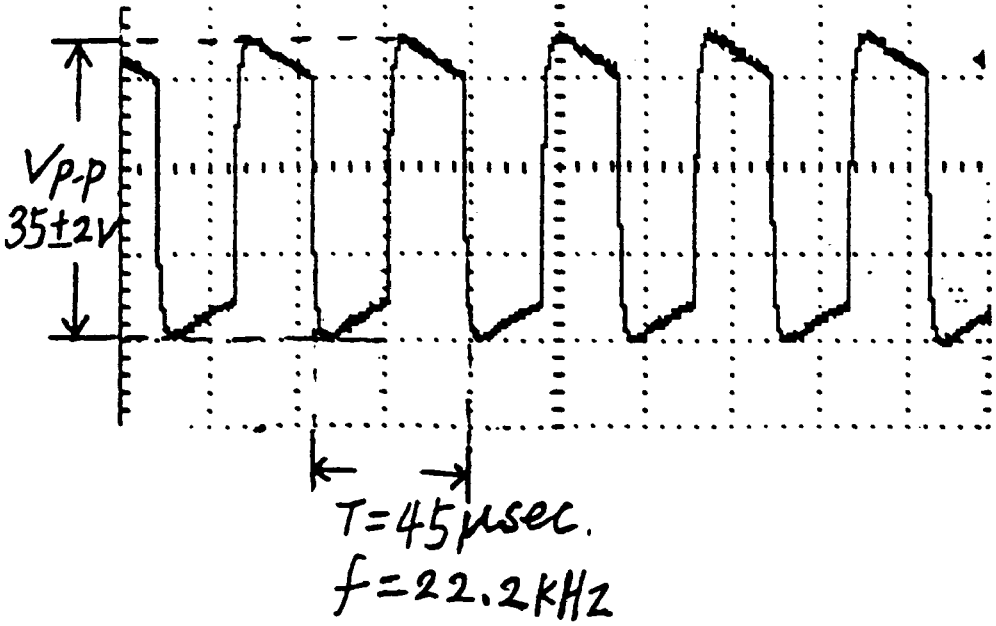
FIG. 3 is an enlarged fragment of the waveform of FIG. 2.

In operation, a 120 VAC 60 Hz input is rectified by the diode bridge to a pulsating DC voltage. After power on through C4, R2 and R3, voltage across D5 increases gradually. When the voltage exceeds the D5 breakdown voltage, D5 will conduct and the semi-bridged push-pull oscillating circuit commences to function. Under control of the oscillating indicators L2, L3, L4, the switching transistors Q1 and Q2 start to conduct alternately, rendering the waveform chopped and inverted. When transistor Q2 is conducting, current flows between the diode bridge output terminals via capacitor C2, transformer coil T1-1, inductor L2 and transistor Q2. When transistor Q2 is off and transistor Q1 starts conducting, current flows between the diode bridge output terminals via transistor Q1, inductor L2, transformer coil T1-1 and capacitor C3. When the input voltage is lower than the pre-set value, the output voltage after rectification is lower than the voltage across capacitor C6. The energy stored in capacitor C6 is released via diode D7 and maintains an oscillating current in the semi-bridged, self-oscillating circuit. The resulting output is a continuous waveform with a power factor greater than 99%. The waveform is shown in FIG. 2, with a greatly enlarged fragment in FIG. 3, from which the resultant high power factor may be appreciated.

It is thus seen that the energy stored in capacitor C6 is used in association with a semi-bridged self-oscillating circuit to produce continuous high frequency rectangular waveform for supplying power to a low voltage halogen lamp at a very high power factor yet, in a simple and unique manner. Operative values of the circuit components in a preferred embodiment are as follows in Table 1 below:

TABLE 1

Operative Values Of A Preferred Embodiment

| Capacitors | | Resistors | |
|---|---|---|---|
| Identifier | (pF) | Identifier | (ohms) |
| C1 | 224 | R1 | 0.5 |
| C2 | 474 | R2 | 82K |
| C3 | 474 | R3 | 33 |
| C4 | 103 | R5 | 8.2K |
| C5 | 102 | | |
| C6 | 47 (uF) | | |

Though the invention has been described in its preferred form it should be understood that modifications may be made thereto without departure from the spirit and scope of the invention as set forth in the following claims.

What is claimed is:

1. A power supply for a gas discharge lamp comprising an oscillating circuit having two switches communicating at a node in series controlled by an oscillating ignition circuit having a diode that operates above a selected voltage threshold level, and an energy storage circuit connected to said node and to said oscillation ignition circuit for supplying energy to said oscillation ignition circuit and said oscillating circuit while voltage across said diode is below said selected voltage threshold level of said diode, said lamp being coupled to said oscillating circuit node and across said energy storage circuit.

2. The power supply circuit of claim 1 wherein said energy storage circuit comprises a capacitor connected on one side to said node of said oscillating circuit switches and to said oscillation ignition circuit through a second diode.

3. The power supply circuit of claim 1 further comprising a rectifier connected to a source of alternating electrical current and communicating a rectified voltage to the energy storage circuit.

4. The power supply circuit of claim 3 wherein said energy storage circuit comprises a capacitor connected on one side to said node of said oscillating circuit switches and to said oscillation ignition circuit through a second diode, whereby said energy storage circuit supplies energy while the voltage after rectification is lower than the voltage across the capacitor.

5. The power supply circuit of claim 1 wherein said oscillating circuit is a push-pull, semi-bridged, self-oscillating circuit.

6. The power circuit of claim 1 wherein the output voltage is high frequency 12 volts or less.

7. A power supply for a gas discharge lamp, comprising a push-pull, semi-bridged, self-oscillating circuit having two switches in series connected at a node and controlled by an oscillation ignition circuit having a diode that operates above a selected voltage threshold level, and an energy storage circuit connected to said diode and to said oscillation ignition circuit for supplying energy to said oscillation ignition circuit and said oscillating circuit while voltage across said diode is below said selected voltage threshold level of said diode, said energy storage circuit comprising a capacitor connected on one side to said oscillating circuit switches through a second diode and to said oscillation ignition circuit and said oscillating circuit through a third diode.

8. The power supply circuit of claim 7 wherein the output voltage is high frequency, 12 volts or less.

9. A method of providing low voltage high frequency electric energy to a gas discharge lamp comprising the steps of:

(a) controlling an oscillating circuit having two switches connected at a node in series with an oscillation ignition circuit having a diode that operates above a selected voltage threshold level; and (b) supplying energy to the oscillation ignition circuit and the oscillating circuit by an energy storage circuit connected to the node of the oscillating circuit switches and to the oscillation ignition circuit to power the oscillation ignition circuit and the oscillating circuit while the voltage across said diode is lower than the selected voltage across said diode threshold level of the diode.

* * * * *